US007624607B2

(12) United States Patent
King

(10) Patent No.: US 7,624,607 B2
(45) Date of Patent: Dec. 1, 2009

(54) UNIVERSAL DEGREE STOP PIPE HAND BENDER

(75) Inventor: Franklin H. King, 3950 Coburg Rd. SPC/34, Eugene, OR (US) 97408

(73) Assignee: Franklin H. King, Eugene, OR (US)

( * ) Notice: Subject to any disclaimer, the term of this patent is extended or adjusted under 35 U.S.C. 154(b) by 0 days.

(21) Appl. No.: 12/074,536

(22) Filed: Mar. 5, 2008

(65) Prior Publication Data

US 2009/0223267 A1 Sep. 10, 2009

(51) Int. Cl.
*B21D 7/02* (2006.01)

(52) U.S. Cl. ..... 72/31.05; 72/149; 72/458; 72/459

(58) Field of Classification Search ..... 72/149, 72/319, 458, 459, 31.05
See application file for complete search history.

(56) References Cited

U.S. PATENT DOCUMENTS

| | | | | |
|---|---|---|---|---|
| 2,847,705 | A * | 8/1958 | Hellwig | 72/31.05 |
| 4,052,881 | A * | 10/1977 | Mount | 72/459 |
| 6,422,054 | B1 * | 7/2002 | White | 72/458 |
| 6,834,527 | B2 * | 12/2004 | Hopwood | 72/459 |

* cited by examiner

*Primary Examiner*—David B Jones
(74) *Attorney, Agent, or Firm*—Franklin H. King

(57) ABSTRACT

A pipe hand bender with v-shaped milled degree ports to accommodate various style stop members and shallow cut degree slots in the outer edges of the bend through walls using a snap in place stop member with v-dents matched to the v-ports.

15 Claims, 6 Drawing Sheets

UNIVERSAL DEGREE STOP PIPE HAND BENDER

BACKGROUND OF THE INVENTION

There are at present several degree stop entities, whereby a pipe being bent in a pipe hand bender is stopped at a preselected degree of bend by various stop members.

One such pipe hand bender head uses a swinging pendulum stop member by Hopwood. U.S. Pat. No. 6,834,527 B2, an other bender head uses a nail fitted into degree through ports in the bender trough.

There is also a unit called a Maxis Speedset. This unit is patent pending. The inventors are the Maxis Company located 1225 W. Houston, Suite 103, Gilbert, Ariz. 85233. This unit is set to the desired degree of bend by attachment to the bender head trough wall. A pointed set-screw is used to set the unit into place.

Both the Hopwood unit as well as the Maxis unit tend to slippage by hand pressure on the pipe being bent. Slippage occurs when large degrees such as 60° or larger is bent. Heavy leverage is used to bend pipe by hand. Scoring of the bender trough wall can occur.

Heavy leverage pressure on both the nails of mount or the sharp edge contact of the Hopwood pendulum stop member can dent the pipe being bent.

The Maxis unit has no definite degree stoppage points. The specifications and drawings show remedies for the shortcomings of the units mentioned.

SUMMARY OF THE INVENTION

This invention will solve related problems to the shortcomings stated in the background of the invention, respectively to each unit so mentioned. An object of the invention is to provide a hand bender head with universal degree v-stop ports for making definite degree pipe bends.

Another object of the invention is to provide means to prevent pipe wall bending with over travel.

DETAIL DESCRIPTION OF THE DRAWINGS

Figure 1:
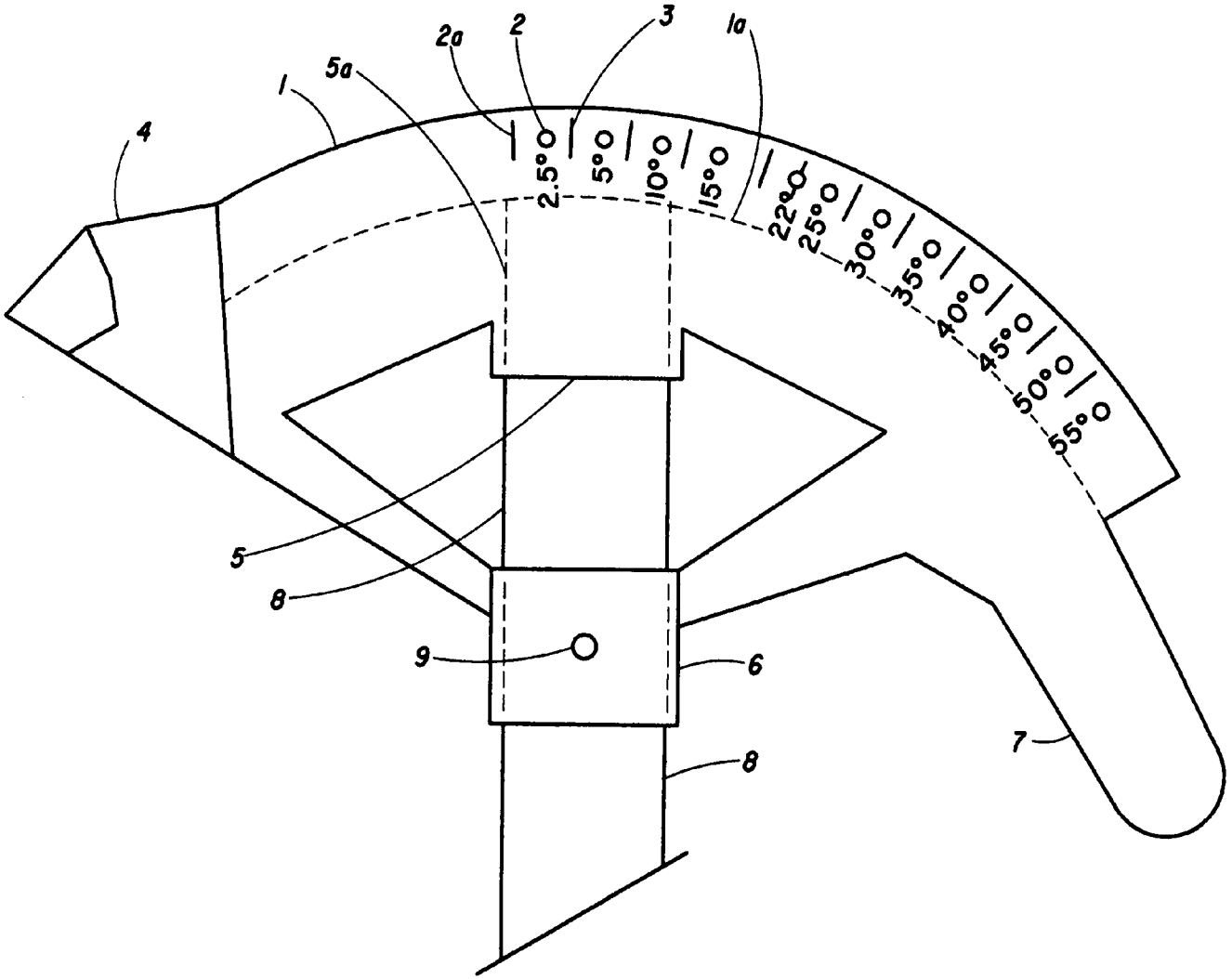
FIG. 1 is a side view of a pipe bender head with v-degree stop ports and a threaded port centered in a slide through bending handle hub.

FIG. 1 shows a hand pipe bender head 1, mounted to a handle 8. Handle 8 is mounted to the bender head 1, by sliding a threaded end through the slide sleeve 6 and threaded into the threads 5*a* of the threaded hub 5.

FIG. 1 also shows a pipe hold down hook 4 at the upper front of the bender head 1, along with degree V-ports 2 progressively distributed and recessed under the outer periphery edges of each bender trough 3 wall. A milled degree slot 2*a* precedes each respective V-port 2. The degree V-ports 2 are shown in graduated degrees of 2½, 5, 10, 15, 22, 25, 30, 35, 40, 45, 50 and 60 degrees. Other V-ports degrees may be used at the discretion of the manufacturer. The aft end of the bender head 1 shows a foot bend lever 7. A threaded through port 9 is drilled through the slide hub 6 wall to accommodate a swivel bolt to hold the bender head 1 stationary in use, and act as a swivel bearing for the flat bearing 9*a* of the pendulum arm 11, lower end.

Figures 2, 3, 4, 5, 6:
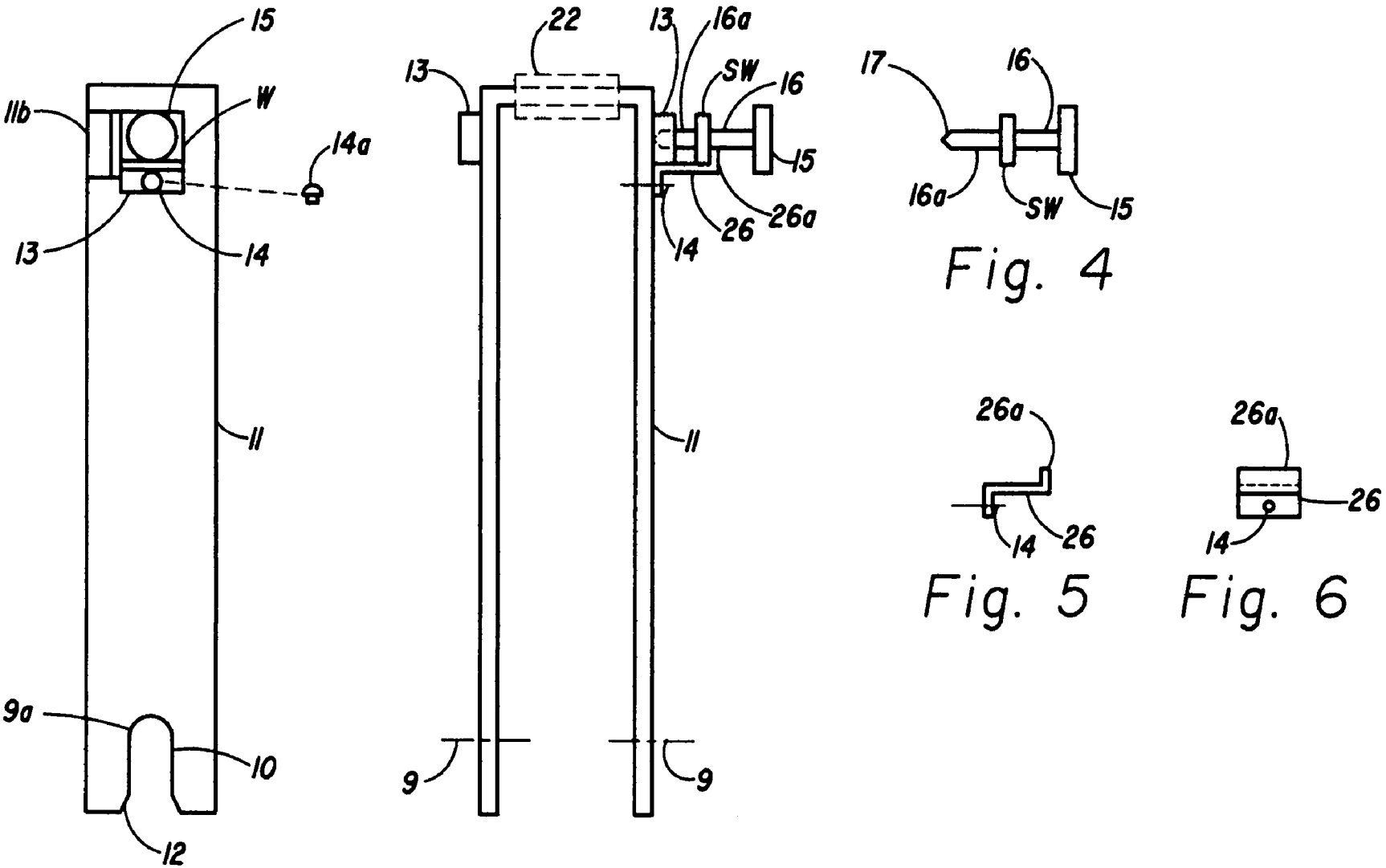
FIG. 2 is a side view of a removable pendulum pipe stop arm fork.
FIG. 3 is a side view of FIG. 2 pendulum stop arm fork, and a degree stop screw.
FIG. 4 is a side view of a degree stop screw of FIG. 3.
FIG. 5 is a side view of a depth gage z bracket.
FIG. 6 is a top view a Z-bracket that acts as a stop to the depth gauge set screw 15 of FIGS. 3 and 4.

FIG. 2 shows a removable pendulum stop arm fork 11 which will here in after be referred to as a stop arm. The stop arm 11 shows a degree indicating knife blade 11*a* cut into the edge of one leg. A slide slot 10 is cut into the lower end of both legs of the stop arm. There is a bevel cut entrance 12 to the slide slot 10, and a crescent cut bearing 9*a* at the upper end of slide slot 10. A threaded rise block 13 is welded to the upper extremity of the stop arm 11 legs in line with the V-ports 2. A threaded degree stop screw 15 is shown threaded into a threaded rise block 13. A z-bent stop block 26 is shown mounted to the legs of the stop arm 11, below a threaded rise block 13 by an exploded view of a setscrew 14*a*. The threaded rise block 13 is typically welded to the stop arm leg at W.

FIG. 3 shows threaded ports 9 in line to the crescent bearing 9*a* of FIG. 2. Threaded rise blocks 13 are shown weld mounted in line in opposed position on either side of the stop arm 11. The degree set screw 15 of FIG. 2 is shown threaded into the threads 13*a* of the threaded rise block 13. A flat stock concave bent pipe buffer 22 is shown welded in place to the leading edge of the stop arm 11 top portion. The degree set screw 15 shows a rear threadless shank section 16. A stop washer SW press fit onto the rear shank section 16, a threaded front shank section 16*a* and set screw point 17.

FIG. 4 is shown covered in FIG. 3 specifications.

FIG. 5 shows a z-bent stop bracket 26 with one right angle outer lip showing an open port 14. The other right angle lip 26*a* is used for a stop tab to stop the stop washer SW.

When the stop washer SW touches the lip of the z-stop bracket 26 it will stop travel. The set screw taper point is freed to allow unrestricted travel for the stop arm 11.

Figure 7:
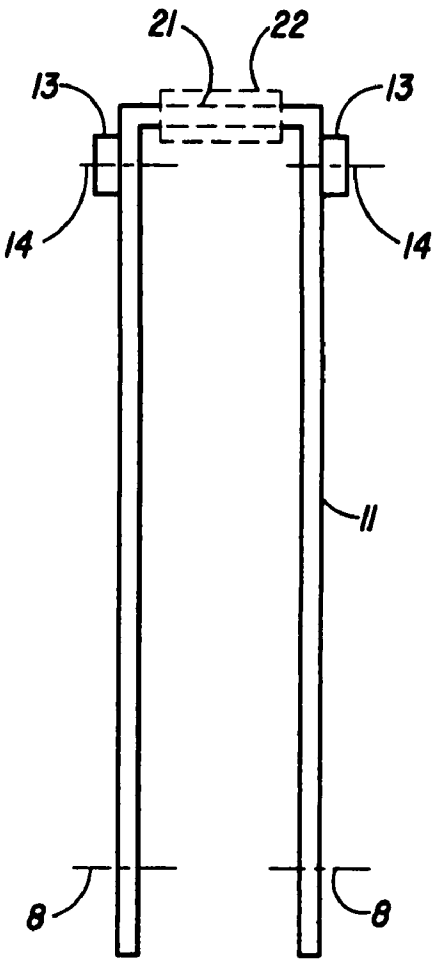
FIG. 7 is a side view of a pendulum stop fork.

FIG. 7 shows a stop arm 11 with oppose mounted threaded rise blocks 13, and threaded ports 14 at the upper edges of the stop arm 11 outer plane walls. FIG. 7 also shows a flat stock concave bend pipe buffer 22 and flat bearings 9, at the lower end of the stop arm legs.

Figures 8, 10:
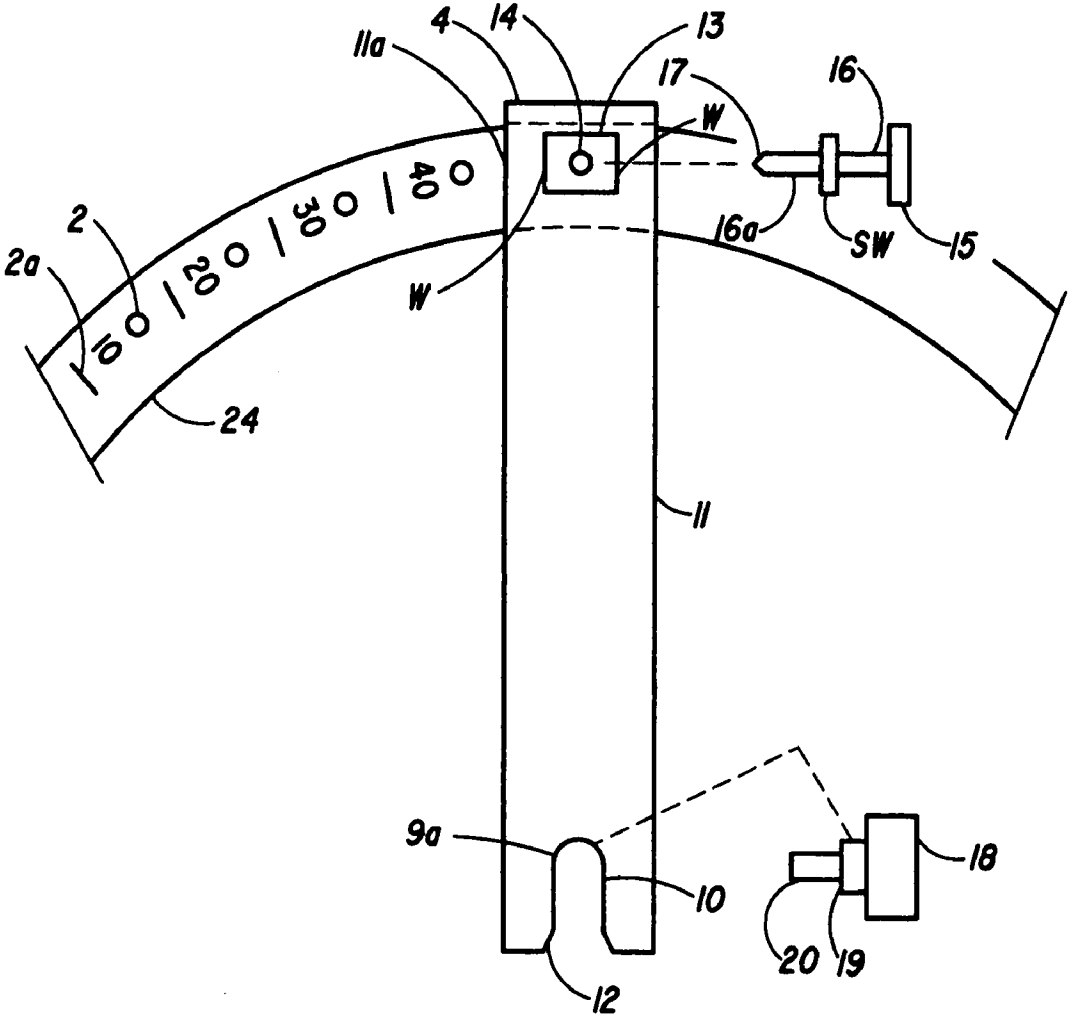
FIG. 8 is a top view of FIG. 7 in place on a cut portion of a bender head with V-ports and a degree stop set screw in exploded position.
FIG. 10 is a side view of a swivel bolt in exploded position from FIG. 8.

FIG. 8 shows the normal position of the stop arm 11 when attached to the slide through hub 6 of FIG. 1. A cut segment 24 from the degree pipe bender head of FIG. 1 shows a degree v-port 2, a degree slot 2*a* and a knife blade marker 11*a*.

Figure 9:
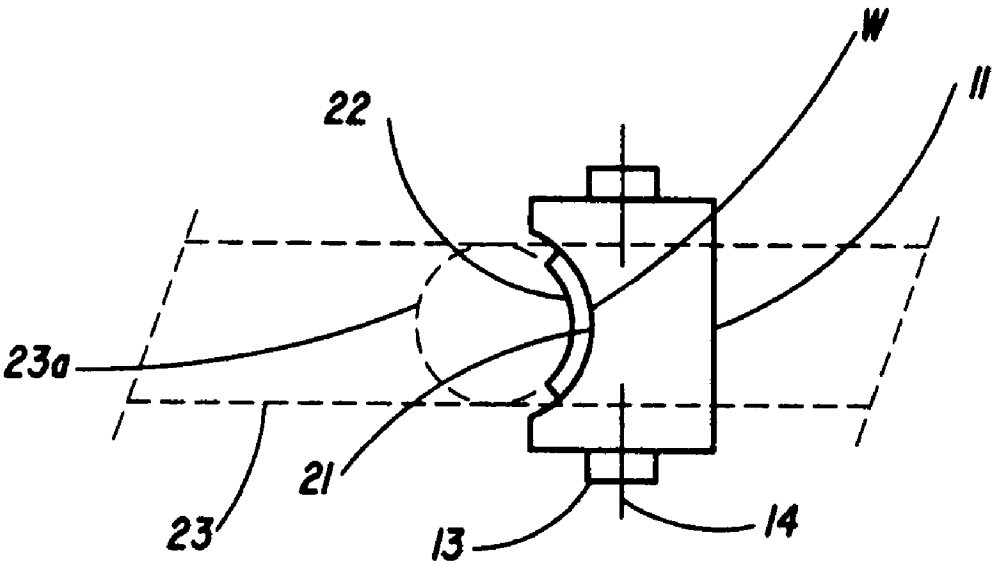
FIG. 9 is a top view of the upper end of FIG. 8 with dash line pipe positions to a concave buffer seat.

FIG. 9 shows a crescent cut 21 in the forward edge of the top flat plane of the stop arm 11, with a flat stock crescent bent matching buffer 22 welded to the face of the crescent cut 21.

Threaded rise blocks 13 are shown in mounting position on each top outer plane of the stop bar 11. A pipe 23 is shown in normal bending position in dash line and a pipe 23*a* is shown matching the flat stock crescent bent buffer 22.

FIG. 10 shows a swivel bolt 18 with a step down bearing shank 19 that acts as a bearing surface for the flat crescent bearing 9 of FIG. 8. Bolt 18 has a threaded step down front shank 20 for use to lock it in place.

Figure 11:
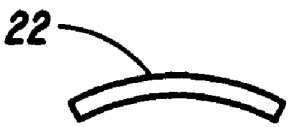
FIG. 11 is a side view of a stop member of FIGS. 7 and 9.
Figure 12:
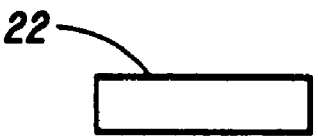
FIG. 12 is a top view of FIG. 11.

FIGS. 11 and 12 shows the flat stock crescent bent flat stock buffer 22.

Figures 13, 14:
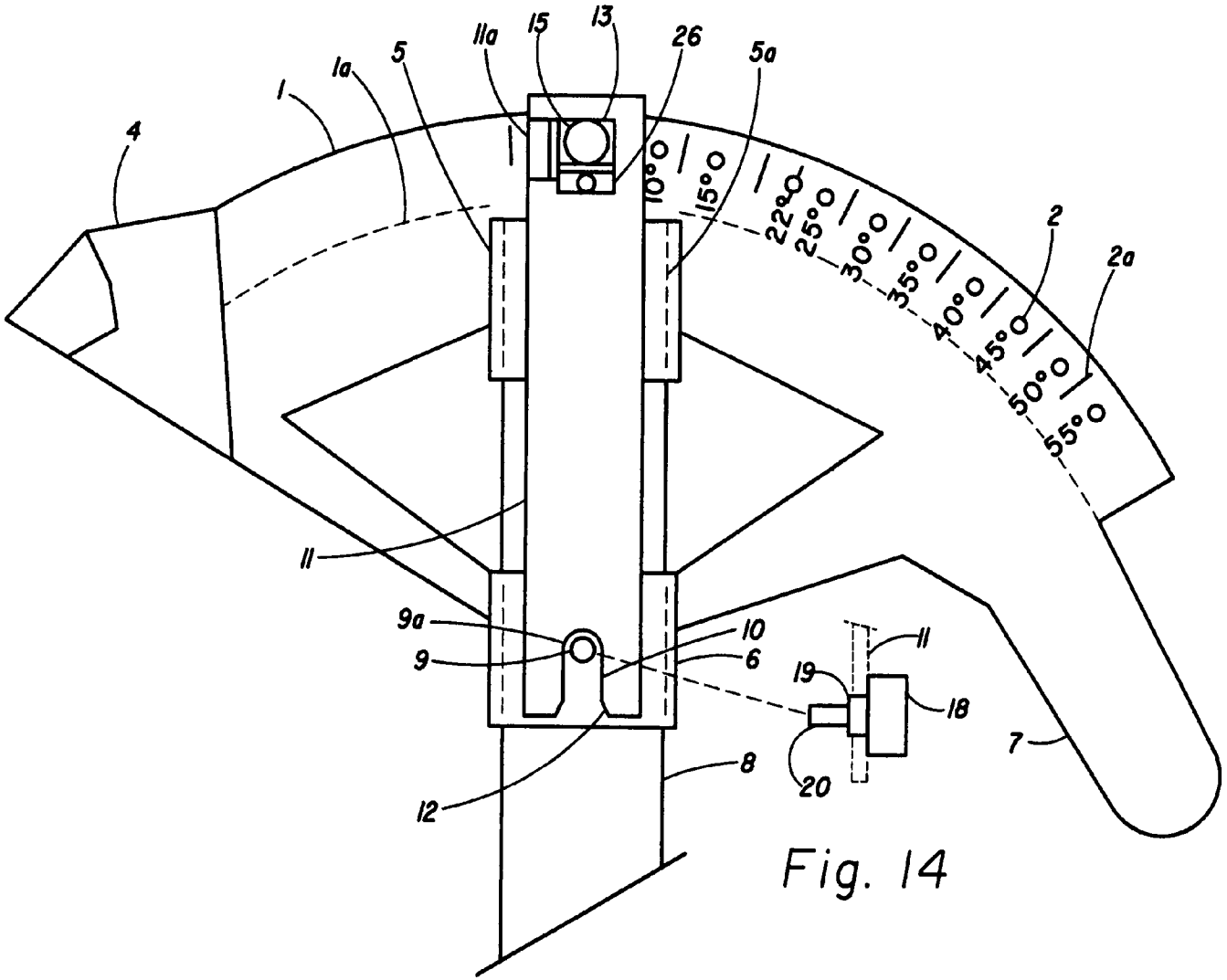
FIG. 13 is a side view of a degree bender head with a removable pendulum stop arm fork.
FIG. 14 is a side view of a swivel bearing set screw with removable pendulum stop arm portion in place, shown in dash line.

FIG. 13 shows all the previously described descriptive elements of FIG. 8.

FIG. 14 shows a stop arm 11 segment in dash line setting in mounted position on the flat bearing of the swivel bolt 18 of FIG. 10.

FIG. 15 to 18 shows an other embodiment to be used with FIG. 1 bender head embodiment.

Figure 15:
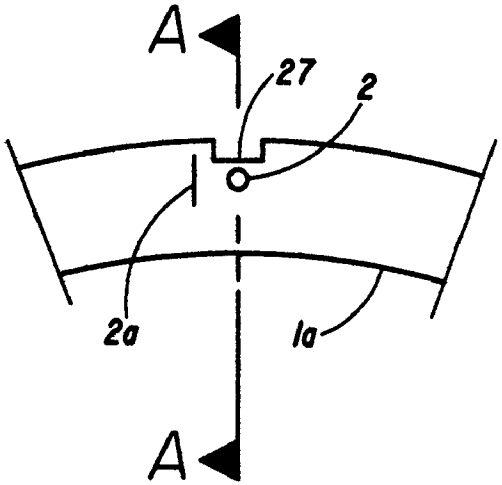
FIG. 15 is a side view of a bender head portion cut at A-A through a shallow slot and a degree V-port.

FIG. 15 shows a cut segment 1*a* from the FIG. 1 bender head embodiment. The cut segment 1*a* shows a square cut shallow slot 27 cut in the outer edges of the bend through 3 walls. The shallow slot 27 sets above and in line to a v-port 2. A cut line A-A is shown cutting the shallow cut slot 27 and the v-port 2.

Figure 16:
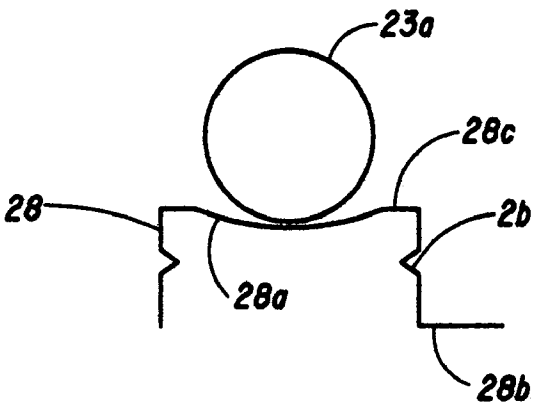
FIG. 16 is an end view of a pipe at rest on a side view of a concaved degree stop member.

FIG. 16 shows a flat spring steel ribbon stop member with a mid section saddle 28*a* concave bent downwards, and two side flaps 28. The two flaps 28 are folded downward into ninety-degree ears from flats 28*c* on each side of the steel ribbon saddle 28*a*. Each ear is of required length to accommodate the punching of v-dents 2*b*. The two v-dents 2*b* point inward toward each other and in line with the v-ports 2. A handle 28*b* is bent outward 90° on an extended ear portion. A pipe 23*a* is shown at rest mid point of the concave saddle 28*a*.

Figure 17:
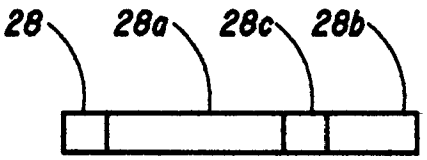
FIG. 17 is a top view of FIG. 16.

FIG. 17 shows the concave saddle 28*a*. the flaps 28 and the handle 28*b*.

Figure 18:
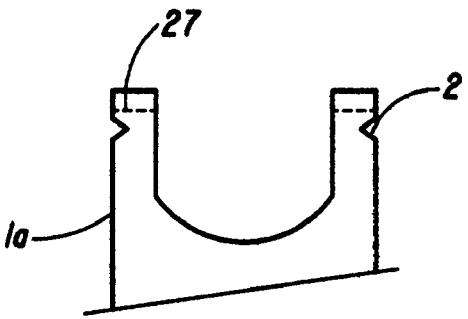
FIG. 18 is an end view of a cut at the FIG. 15 bender section.

FIG. 18 shows the cut A-A of FIG. 15 passing through the shallow slot 27 and the v-port 2.

In Use

To use the FIG. 1 pipe hand bender to bend a pipe proceed as follows: insert the end of the pipe under the pipe hold down hook 4, then pull down the pipe into the bend trough 3 until it touches a stop member set at a predetermined v-port 2.

In use the FIG. 1 embodiment maybe used for anchoring the three embodiments of the drawings to bend a pipe. Using the Maxis Speedset as a stop member proceed as follows; select the v-port 2 representing the degree of bend desired and place the set screw point in-line with chosen v-port 2, advance the set screw until it bottoms out in the v-port 2. Insert the pipe into the FIG. 1 bender head and bend until the pipe contacts the stop member body signaling bend completion. A perfect degree bend is obtained. The v-walls of the set screw point and v-port 2 will adjust to a perfect degree setting of the Maxis Speedset body.

To use the FIG. 16 stop member embodiment using the FIG. 1 embodiment proceed as follows. Select a shallow degree slot 27 and using the handle 28*b* align the flaps 28 with the selected shallow degree slot 27. Press the stop member downward spreading the flaps 28 outward until the v-dents 2*b* snap into place in the in-line v-port 2 below the shallow degree slot 27. Place a pipe to be bent in the FIG. 1 bender head. Bend the pipe until the contact pressure is felt between the pipe and the stop member. The concave saddle 28*a* will allow a shallow cut plus prevent denting of the pipe as a sharp edge would.

The FIG. 2 to 14 embodiment is used with the FIG. 1 hand bender head embodiment as follows: first mount the FIG. 10 swivel bolt 18 to the slide through hub 6 of FIG. 1 bender head. The threaded shank 20 is threaded into the threads of the threaded port 9 centered in the hub 6 until the flat bearing body 19 bottoms out against the outer plane of the hub 6. The stop arm 11 can now be mounted to the FIG. 1 embodiment. Unscrew the two-degree set screws 15 until the stop washer SW pressed onto the rear shank 16 contacts the right angle off set tip 26*a* of the z-bracket 26.

As can be seen by reference to FIGS. 1 and 18, V-ports 2 are conical-shaped openings milled into the bender trough wall 3 that are V-shaped in cross-section and adapted to receive and mate with the V-shaped cross-section of the set screw point 17 of set screw 15.

The threaded front shank of the set screw 15 can advance or retract in the threaded 13*a* ports of the threaded rise block 13. This allows mounting of the stop arm 11 or its removal from the FIG. 1 bender head.

To mount the stop arm 11 to the bender head of FIG. 1, align the slide slot 10 with the flat bearing 19 and slide the stop arm 11 in place. Choose a degree slot 2*a* to align the knife blade to the degree slot 2. Advance the set screw 15 until the set screw point 17 bottoms out in the v-port. Now the other screw may be set in the opposed v-port. This gives a solid anchor to the stop arm 11. A bend can now be made on a pipe. Insert the pipe into the bender head and pull the pipe down until its edge touches the crescent bent buffer 22.

The flat buffer 22 is used to prevent pipe denting. The same results maybe had by using a concave crescent cut 21 of the FIG. 9. The stop arm maybe removed for use of the bend lever 7 for foot bending or when stowing away when the bender is not in use.

The three uses covered are with the air bend method. The air bend method is done by placing the outer end of the handle 8 on a surface such as a floor. The pipe is pulled into the trough 1*a*, by hand.

It will be obvious to those skilled in the art that many changes maybe made to the details of the above-mentioned embodiments of this invention without departing from the underlying principles thereof.

The scope of the present invention should therefore be determined only by the following claims.

The invention claimed is:

1. In a pipe bender including a bender head having an arcuate pipe receiving channel formed by bender head trough walls, and a handle connected at one end to said bender head, the improvement comprising:

a plurality of graduated degree V-ports extending into at least one of said bend trough walls at graduated degree intervals, and degree value indicia marked on said bend trough wall adjacent each of said V-ports; and a bend stop member adjustable at least along the length of said bender head trough wall containing said graduated degree V-ports, said bend stop member including means adapted to be aligned with, and at least partially received within, a selected graduated degree V-port.

2. The pipe bender of claim 1 wherein said bend stop member has an upper end and a lower end, said lower end being pivotally attached to said bender head, said upper end being positioned immediately over said bender head trough walls and adjustable at least along the length of said bender head trough wall containing said graduated degree V-ports, said upper end having a concave upper surface for receiving a pipe being bent; and a stop screw threadably attached to said bend stop member adjacent said upper end thereof, said stop screw adapted to be aligned with, and be at least partially received within, a selected graduated degree V-port.

3. In a pipe bender including a bender head having an arcuate pipe receiving channel formed by bender head trough walls, and a handle connected at one end to said bender head, the improvement comprising:

a plurality of graduated degree V-ports extending into at least one of said bend trough walls at graduated degree intervals, and degree value indicia marked on said bend trough wall adjacent each of said V-ports;

a bend stop member having an upper end and a lower end, said lower end being pivotally attached to said bender head, said upper end being positioned immediately over said bender head trough walls and adjustable at least along the length of said bender head trough wall containing said graduated degree V-ports, said upper end having a concave upper surface for receiving a pipe being bent;

a stop screw threadably attached to said bend stop member adjacent said upper end thereof, said stop screw adapted to be aligned with, and be at least partially received within, a selected graduated degree V-port; and a degree slot formed in said bend trough wall adjacent each of said V-ports, said bend stop member including a degree indicating member adapted to be aligned with a degree slot adjacent a selected graduated degree V-port to thereby align said stop screw with said selected graduated degree V-port.

4. The pipe bender of claim 3 wherein said bend stop member is a generally inverted U-shaped body having substantially parallel legs extending downwardly from a cross member forming said upper end.

5. The pipe bender of claim 4 wherein each of said legs has a side slot located at the lower end thereof, each of said side slots having an upper end forming a bearing surface, and a swivel bolt passing through each of said side slots, each of said swivel bolts having a bearing shank portion in contact with said bearing surface of said side slots, said swivel bolt being fastened at its inner end to said bender head.

6. The pipe bender of claim 4 wherein the upper portion of at least one of said legs has a threaded port adapted to receive said stop screw.

7. The bend stop member of claim 6 including a stop washer attached to the shank of said stop screw at a mid-portion thereof, and a stop block having a portion adapted to abut said stop washer upon withdrawal of said stop screw from said threaded port and prevent further withdrawal thereof.

8. The bend stop member of claim 7 wherein said stop block is a Z-shaped member having one lip attached to said bend stop member below said threaded port, the other lip forming that portion adapted to abut said stop washer upon withdrawal of said stop screw.

9. The pipe bender of claim 3 wherein said degree indicating member is a knife blade formed in one of the edges of the upper portion of the leg located adjacent the wall of said bender head containing said V-ports, degree value indicia, and degree slots.

10. A bend stop member for use with a pipe bender of the type having a bender head having an arcuate pipe receiving channel formed by bender head trough walls, and a handle connected at one end to said bender head, said bend stop member comprising:

a generally inverted U-shaped body having substantially parallel legs extending downwardly from a cross member forming an upper end, said cross member having a concave upper surface for receiving a pipe being bent;

each of said legs having a side slot located at the lower end thereof, each of said side slots having an upper end forming a bearing surface adapted to receive a bearing shank portion of a swivel bolt;

the upper portion of at least one of said legs having a threaded port adapted to receive a stop screw; and a stop screw threadably engaging said threaded port.

11. The bend stop member of claim 10 including a degree indicating member adapted to be aligned with a degree slot indicia located on at least one bender head trough wall of said pipe bender.

12. The bend stop member of claim 11 wherein said degree indicating member is a knife blade formed in one of the edges of the upper portion of the leg to be located adjacent the trough wall of said pipe bender head containing said degree slots.

13. A bend stop member for use with a pipe bender of the type having a bender head having an arcuate pipe receiving channel formed by bender head trough walls, and a handle connected at one end to said bender head, said bend stop member comprising:

a generally inverted U-shaped body having substantially parallel legs extending downwardly from a cross member forming an upper end, said cross member having a concave upper surface for receiving a pipe being bent;

each of said legs having a side slot located at the lower end thereof, each of said side slots having an upper end forming a bearing surface adapted to receive a bearing shank portion of a swivel bolt;

the upper portion of at least one of said legs having a threaded port adapted to receive a stop screw;

a stop screw threadably engaging said threaded port; and a stop washer attached to the shank of said stop screw at a mid-portion thereof, and a stop block having a portion adapted to abut said stop washer upon withdrawal of said stop screw from said threaded port and prevent further withdrawal thereof.

14. The bend stop member of claim 13 wherein said stop block is a Z-shaped member having one lip attached to said bend stop member below said threaded port, the other lip forming that portion adapted to abut said stop washer upon withdrawal of said stop screw.

15. In a pipe bender including a bender head having an arcuate pipe receiving channel formed by bender head trough walls, and a handle connected at one end to said bender head, the improvement comprising:

a plurality of graduated degree V-ports extending into at least one of said bend trough walls at graduated degree intervals, and degree value indicia marked on said bend trough wall adjacent each of said V-ports;

a plurality of adjacent pairs of slots located in the outer portion of each of said bend trough walls adjacent said V-ports; and a bend stop member having a concave upper wall having first and second ends adapted to be received in a selected pair of slots, first and second side flaps extending downwardly from said first and second ends of said concave upper wall, respectively, and a member extending inwardly from at least one of said first and second side flaps and adapted to be received into the V-port located adjacent thereto.

* * * * *